US006684409B2

(12) United States Patent
Fujihana

(10) Patent No.: US 6,684,409 B2
(45) Date of Patent: Feb. 3, 2004

(54) WORK GLOVE

(75) Inventor: Terukazu Fujihana, Hyogo (JP)

(73) Assignee: Showa Co., Ltd. (JP)

( * ) Notice: Subject to any disclaimer, the term of this patent is extended or adjusted under 35 U.S.C. 154(b) by 0 days.

(21) Appl. No.: 10/413,084

(22) Filed: Apr. 14, 2003

(65) Prior Publication Data

US 2003/0200592 A1 Oct. 30, 2003

(30) Foreign Application Priority Data

Apr. 24, 2002 (JP) ..... 2002-121531

(51) Int. Cl.[7] ..... A41D 19/00
(52) U.S. Cl. ..... 2/161.6; 2/20
(58) Field of Search ..... 2/16, 20, 59, 161.6, 2/167, 161.7, 169

(56) References Cited

U.S. PATENT DOCUMENTS 4,445,232 A * 5/1984 Nelson ..... 2/16
4,757,555 A * 7/1988 Gold ..... 2/16
4,967,419 A * 11/1990 Elliott ..... 2/16
5,924,130 A * 7/1999 Fragomeli ..... 2/16

* cited by examiner

*Primary Examiner*—Katherine Moran
(74) *Attorney, Agent, or Firm*—Mark Kusner; Michael A. Jaffe

(57) ABSTRACT

An easy-to-use and inexpensive work glove is provided. For this purpose, the work glove integrally comprises a first section for covering a region extending from a forearm middle portion between the wrist and an elbow to a hand, and a second section for covering an upper arm above the elbow, the second section extending from the first section. The first and second sections are each formed by applying a coating material such as natural rubber, synthetic rubber or synthetic resin onto a surface of a knitted fiber glove portion. The fiber glove portion of the second section is knitted from a thinner yarn to be smaller in thickness and has a higher stitch density than the fiber glove portion of the first section, and the second section has a thinner coating film formed on the surface of the fiber glove portion than that of the first section.

1 Claim, 3 Drawing Sheets

WORK GLOVE

TECHNICAL FIELD

The present invention relates to a work glove suitable for use in various works in fishery, agriculture or the like.

BACKGROUND ART

Conventionally, a work glove for use in various works in fishery, agriculture or the like is known which includes a section for covering an upper arm above an elbow, continuously extending from a section for covering a hand.

For covering also the upper arm above the elbow when attached to the hand, such a known work glove is formed by joining the section for covering the upper arm above the elbow to a section for covering a region extending from a forearm middle portion between a wrist and the elbow to the hand. More specifically, the section for covering the region extending from the forearm middle portion between the wrist and the elbow to the hand is prepared by applying a coating material such as a natural rubber, a synthetic rubber or a synthetic resin onto the surface of a fiber glove portion knitted from a cotton yarn, a synthetic fiber yarn or a blend yarn of these yarns. To this section, the upper arm covering section is connected by adhesive bonding or fusion bonding. The upper arm covering section has a cylindrical shape, and is formed of a resin film sheet which is thinner than the section of the fiber glove portion coated with the coating material. In this way, the section for covering the region extending from the forearm middle portion between the wrist and the elbow to the hand and the section for covering the upper arm above the elbow, which are joined together, differ from each other in thickness, because the section for covering the upper arm above the elbow is made relatively thin to minimize its influence on movements at the elbow joint in working.

However, such a conventional work glove has a problem that the production thereof requires a process for forming the section for covering the region extending from the forearm middle portion between the wrist and the elbow to the hand and the section for covering the upper arm above the elbow into different thicknesses and joining these sections together. This deteriorates the manufacturing efficiency, leading to an increase in cost. Further, a joined portion of the glove is more liable to be damaged, so that the glove cannot endure a long term use. Particularly, there exists a problem that water is likely to intrude into the glove from the joined portion.

DISCLOSURE OF THE INVENTION

To solve the aforesaid problems, it is an object of the present invention to provide an easy-to-use, inexpensive and durable work glove by integrally forming a section for covering a region extending from a forearm middle portion between a wrist and an elbow to a hand and a section for covering an upper arm above the elbow.

For attaining this object, the summary of the present invention is as follows.

There is provided a work glove which comprises a first section for covering a region extending from a forearm middle portion between a wrist and an elbow to a hand, and a second section for covering an upper arm above the elbow, the second section being provided integrally with the first section as extending from the first section, wherein each of the first and second sections comprises a knitted fiber glove portion and a coating film formed by applying a coating material onto a surface of the fiber glove portion, the coating material being selected from a group consisting of a natural rubber, a synthetic rubber and a synthetic resin, wherein the fiber glove portion of the second section is formed by using a thinner yarn to have a smaller thickness and to have a higher stitch density than those of the fiber glove portion of the first section, and the coating film of the second section has a smaller thickness than the coating film of the first section.

As described above, the work glove includes the first section for covering the region extending from the forearm middle portion between the wrist and the elbow to the hand and the second section for covering the upper arm above the elbow, and the second section is provided integrally with the first section as extending from the first section. The first section for covering the region extending from the forearm middle portion between the wrist and the elbow to the hand is made thicker to provide a sufficient strength to endure various works, whereas the second section for covering the upper arm above the elbow is made thinner so as not to hinder the movements at the elbow joint. Thus, it is possible to provide a work glove which is free from the problems of the prior art work glove such as a breakage of the joined portion or an intrusion of water from the joined portion, and which is easy to use, inexpensive, and capable of enduring a long term use.

DESCRIPTION OF THE PREFERRED EMBODIMENT

Figure 1:
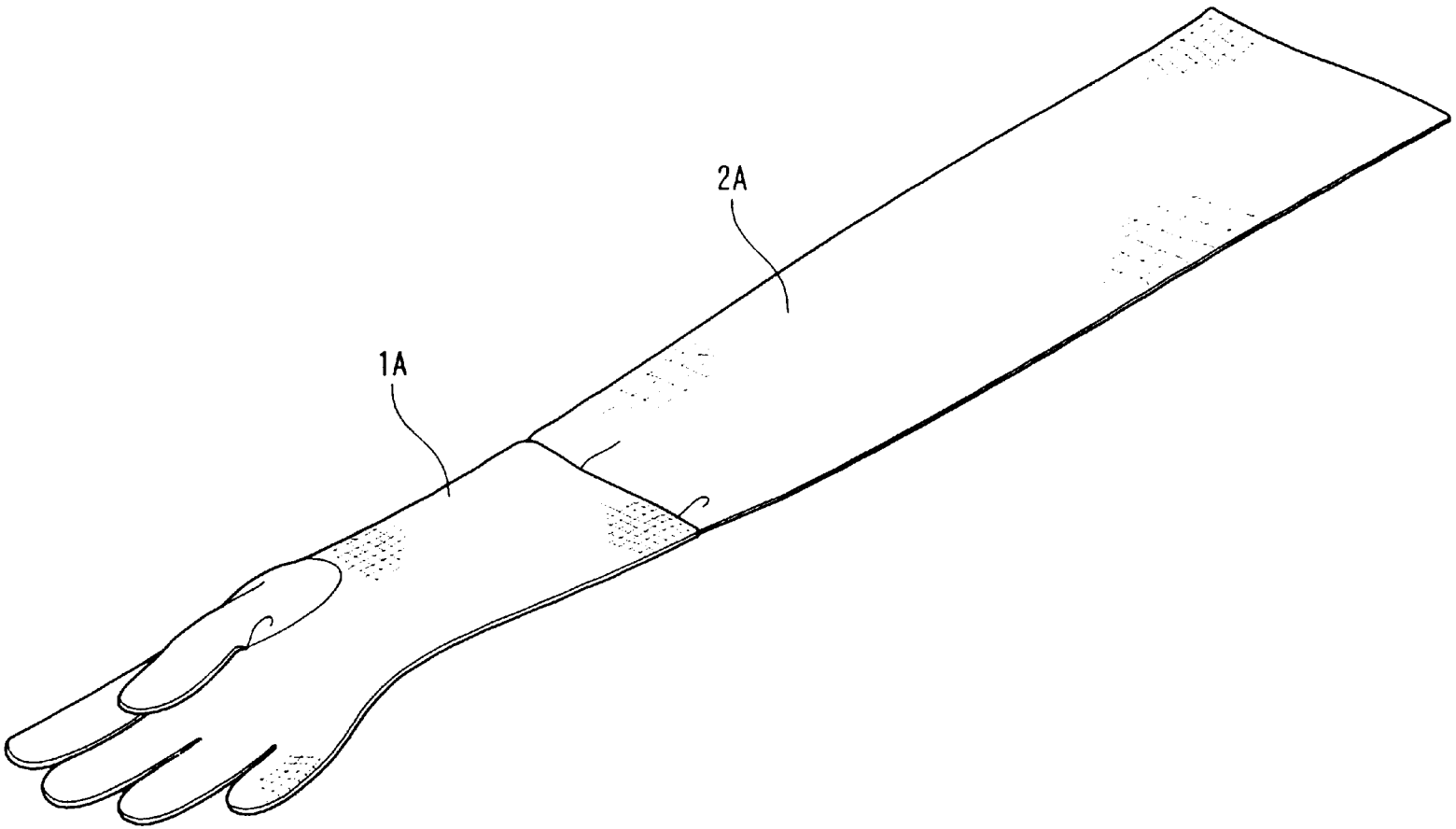
FIG. 1 is an explanatory diagram illustrating fiber glove portions of a work glove according to one embodiment of the present invention.
Figure 2:
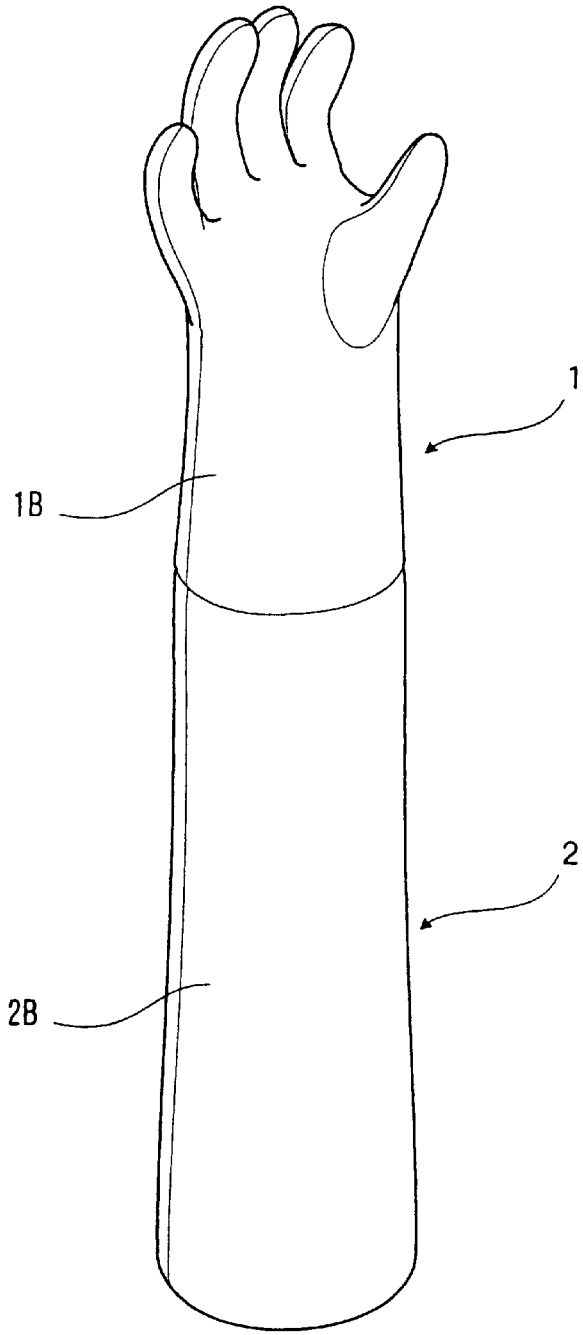
FIG. 2 is a perspective view of the work glove.
Figure 3:
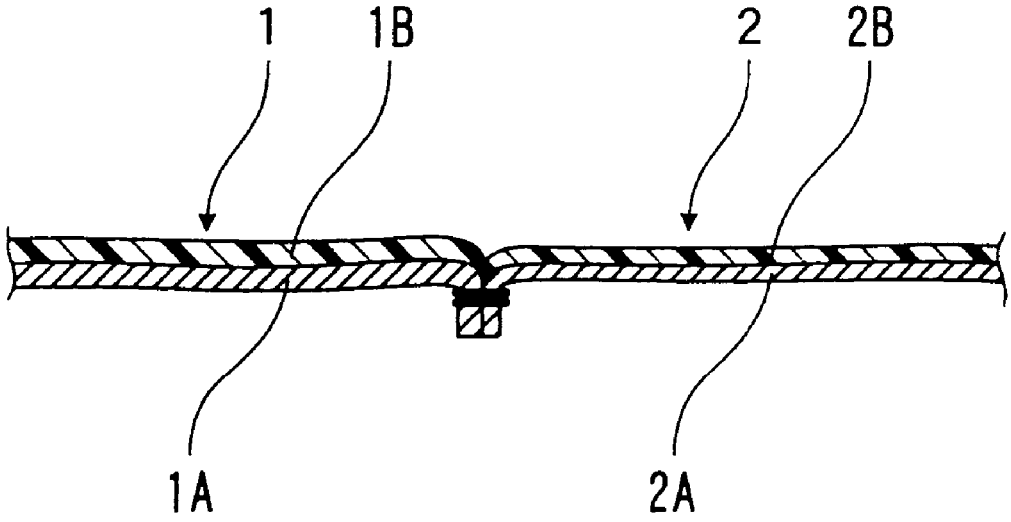
FIG. 3 is an enlarged sectional view illustrating a principal portion of the work glove.

FIGS. 1 to 3 illustrate one embodiment of the present invention.

In FIGS. 1 to 3, a reference numeral 1 denotes a section for covering a region extending from a forearm middle portion between a wrist and an elbow to a hand, and a reference numeral 2 denotes a section for covering an upper arm above the elbow, which is connected to the section 1 for covering the region extending from the forearm middle portion between the wrist and the elbow to the hand.

The section 1 for covering the region extending from the forearm middle portion between the wrist and the elbow to the hand (finger tips) and the section 2 for covering the upper arm above the elbow may be formed by applying a coating material such as a natural rubber, a synthetic rubber or a synthetic resin onto surfaces of fiber glove portions 1A and 2A knitted from a cotton yarn, a synthetic fiber yarn or a blend yarn of these yarns. The fiber glove portion 2A is knitted from a thinner yarn than the fiber glove portion 1A, and has a smaller thickness and a higher stitch density than the fiber glove portion 1A. The fiber glove portions 1A and 2A thus prepared are sewed together in advance, and the aforesaid coating material is applied onto the surfaces of the fiber glove portions 1A and 2A thus sewed together for formation of coating films 1B and 2B.

More specifically, the fiber glove portion 1A of the section 1 for covering the region extending from the forearm middle portion between the wrist and the elbow to the hand is knitted from a yarn having a cotton yarn count of 32 at a stitch density of 35 courses/inch and 35 wales/inch. The fiber glove portion 2A of the section 2 for covering the upper arm above the elbow is knitted from a yarn having a cotton yarn count of 60 at a stitch density of 45 courses/inch and 40 wales/inch. Further, the coating film 1B formed on the surface of the fiber glove portion 1A of the section 1 for covering the region extending from the forearm middle portion between the wrist and the elbow to the hand has a thickness of 170 $\mu$m, whereas the coating film 2B formed on the surface of the fiber glove portion 2A of the section 2 for covering the upper arm above the elbow has a thickness of 155 $\mu$m. In this way, the coating film 2B formed on the surface of the fiber glove portion 2A of the section 2 for covering the upper arm above the elbow is made thinner than the coating film 1B formed on the surface of the fiber glove portion 1A of the section 1 for covering the region extending from the forearm middle portion between the wrist and the elbow to the hand.

As described above, the fiber glove portion 2A has a higher stitch density and, hence, has smaller and tighter loops than the fiber glove portion 1A. Therefore, when the fiber glove portions 1A and 2A sewed together are dipped in and taken out of a coating material liquid and then dried with the coating material applied onto the surfaces of the fiber glove portions 1A and 2A for the formation of the coating films, or when the coating material liquid is poured over the fiber glove portions 1A and 2A and dried with the excess of the liquid dripped off for the formation of the coating films, the coating material liquid is less likely to infiltrate into the loops of the fiber glove portion 2A which is knitted from a thinner yarn at a higher stitch density thereby to have a generally flat surface with smaller loops. Therefore, a relatively small amount of the coating material liquid adheres onto the surface of the fiber glove portion 2A. On the other hand, a greater amount of the coating material liquid adheres onto the surface of the fiber glove portion 1A than onto the fiber glove portion 2A, because the fiber glove portion 1A is knitted from a thicker yarn at a lower stitch density thereby to have larger loops than the fiber glove portion 2A.

As described above, the work glove according to this embodiment includes the section 1 for covering the region extending from the forearm middle portion between the wrist and the elbow to the hand and the section 2 for covering the upper arm above the elbow, the section 2 being provided integrally with the section 1 as extending from the section 1. The work glove is characterized in that the section 1 for covering the region extending from the forearm middle portion between the wrist and the elbow to the hand is made thicker to provide a sufficient strength to endure various works, whereas the section 2 for covering the upper arm above the elbow, which is provided as extending from the section 1 for covering the region extending from the forearm middle portion between the wrist and the elbow to the hand, is made thinner. so as not to hinder the movements at the elbow joint.

What is claimed is:

1. A work glove comprising a first section for covering a region extending from a forearm middle portion between a wrist and an elbow to a hand, and a second section for covering an upper arm above the elbow, the second section being provided integrally with the first section as extending from the first section, wherein each of the first and second sections comprises a knitted fiber glove portion and a coating film formed by applying a coating material onto a surface of the fiber glove portion, the coating material being selected from a group consisting of a natural rubber, a synthetic rubber and a synthetic resin, the fiber glove portion of the second section is formed by using a thinner yarn to have a smaller thickness and to have a higher stitch density than those of the fiber glove portion of the first section, and the coating film of the second section has a smaller thickness than the coating film of the first section.

* * * * *